United States Patent [19]

Spademan

[11] Patent Number: 4,686,780

[45] Date of Patent: Aug. 18, 1987

[54] MULTIDIRECTIONAL DYNAMIC FITTING SYSTEM FOR A SKI BOOT

[76] Inventor: Richard G. Spademan, P.O. Box 6410, Incline Village, Nev. 89450

[21] Appl. No.: 789,304

[22] PCT Filed: Feb. 11, 1985

[86] PCT No.: PCT/US85/00215

§ 371 Date: Oct. 8, 1985

§ 102(e) Date: Oct. 8, 1985

[87] PCT Pub. No.: WO85/03416

PCT Pub. Date: Aug. 15, 1985

[51] Int. Cl.[4] ..... A43B 5/04

[52] U.S. Cl. ..... 36/121

[58] Field of Search ..... 36/117, 118, 119, 120, 36/121, 109

[56] References Cited

U.S. PATENT DOCUMENTS

| | | | |
|---|---|---|---|
| 3,828,448 | 8/1974 | Leonildo | 36/119 |
| 4,196,530 | 4/1980 | Delery | 36/119 |
| 4,222,184 | 9/1980 | Kastinger | 36/118 |
| 4,338,735 | 7/1982 | Spademan | 36/119 |
| 4,360,979 | 11/1982 | Spademan | 36/121 |
| 4,382,342 | 5/1983 | Spademan | 36/119 |
| 4,406,073 | 9/1983 | Spademan | 36/119 |
| 4,426,796 | 1/1984 | Spademan | 36/119 |
| 4,447,968 | 5/1984 | Spademan | 36/109 |
| 4,494,324 | 1/1985 | Spademan | 36/119 |

*Primary Examiner*—Werner H. Schroeder

*Attorney, Agent, or Firm*—Townsend and Townsend

[57] ABSTRACT

A sport shoe is disclosed in which there is provided a foot engaging means, a leg engaging means, and an assembly for moving the foot and leg engaging means for increasing the tightness of the fit of the shoe on the foot when the leg is moved forwardly and rearwardly relative to the foot from the normal position of the foot relative to the leg.

20 Claims, 6 Drawing Figures

MULTIDIRECTIONAL DYNAMIC FITTING SYSTEM FOR A SKI BOOT

BACKGROUND OF THE INVENTION

Sport shoes such as ski boots must fit tightly on the user's lower extermity. During certain maneuvers, with a ski boot in turning a ski, for example, the tightness of the fit needs to be greater than during other times when the forces transmitted between the lower extremity and the ski are not as severe. Generally, the force required for a carved turn is applied to a ski using forward, neutral or rearward leverage depending on the conditions and the performance required. Most turns are initiated with forward leverage to increase control of the ski tip. Forward leverage places the most severe part of the reversed camber toward the tip of the ski; however, if forward leverage is maintained throughout a turn, the tip acts as a brake and causes excessive chatter. For this reason, as soon as the tip establishes the desired arc of the turn, the pressure on the ski is typically moved to the center of the ski or a position of neutral leverage. During certain maneuvers as during long radius turns on relatively flat terrain or soft snow, rearward lean against the ski boot cuff is used to increase leverage on the ski. On steeper terrain, turns are often ended with rearward leverage to provide acceleration. Lean against the rear cuff of the ski boot is also applied during the completion of the arc of a turn in slalom racing.

In the past, it was typical to tighten the ski boot as much as possible, and physically bearable, to prevent or at least minimize relative movement of the lower extremity in the boot at times when maximum force and leverage are transmitted between the foot, the leg and the boot. As a practical matter, such a fit is excessively tight during most other times and quite frequently is uncomfortable, can lead to numbness and in extreme cases, can result in injuries. Thus, a compromise is frequently reached by tightening the boot on the foot and leg more than is necessary for the small forces that are applied and less than is desired to prevent relative movement of the foot and leg in the boot when large leverage forces are applied. Consequently, the fit of such ski boots is almost always other than what it should be.

The problem has been recognized in the past in connection with ski boots where the exerted leverage forces are especially large and the required tightness of the fit for extreme maneuvers is typically unbearable for any length of time. This inventor has developed dynamic fitting systems which temporarily increase the tightness of the fit of the ski boot on the foot in response to certain skiing maneuvers. In these disclosures, the boot, or at least a portion of the boot increases in tightness in response to a forward lean of the skier.

Analysis of certain skiing maneuvers has shown that the ski boot should tighten in both forward and rearward lean from the normal skiing position. Particularly in competitive skiing when weight shifting is extreme and forward and rearward leverage is applied to the ski boot cuff to change the camber of the ski, dynamic tightening is essential to transfer the maximum energy to the ski tip and tail.

SUMMARY OF THE INVENTION

The present invention greatly reduces relative movement between the lower extremity and the ski boot by increasing the tightness of the boot on the foot and leg during turning as a function of foot and leg movement away from the normal relaxed position used in skiing for tracking. The tightness of the fit is reduced when the lower extremity is in the normal position when minimum forces are exerted, to reduce discomfort from an overtightening of the boot for excessive lengths of time.

In view of the foregoing, a principal object of the present invention is a multidirectional dynamic fitting system for a ski boot for dynamically tightening the fit of the ski boot in both forward and rearward lean of the lower extremity.

Another object of the present invention is a ski boot in which there is provided means for engaging the foot and leg and means coupled to the foot and leg engaging means for adjusting the position of the foot and leg engaging means relative to the foot and leg in response to movement of the lower extremity.

Another object of the present invention is a ski boot as described above in which there is provided a means for tightening the fit of the ski boot in response to forward and rearward lean of the leg relative to the foot.

Still another object of the present invention is a movable footbed and cable connected to the front cuff that move upwardly and downwardly to increase the tightness of the fit of the shell and cuffs on the lower extremity in response to forward and rearward movement of the front and rear cuffs.

Still another object of the present invention is a strap mechanism connected to a sliding front cuff that tightens the shell flaps against the leg and foot in response to forward and rearward movement of the front and rear cuffs.

Still another object of the present invention is an instep tongue and cable mechanism connected to the sliding front cuff that is adjustable for the normal position and that tightens in response to forward and rearward movement of the front cuff.

BRIEF DESCRIPTION OF THE DRAWINGS

Referring to FIGS. 1 and 2, there is provided in accordance with the present invention a ski boot 1 which has a front cuff 2 and a rear cuff 3 movably attached to a shell 4. Ski boot 1 includes an attachment shaft 5 that passes through both sides of the shell 4. Front cuff 2 can rotate with shaft 5. The pivotal movement accommodates to forward lean. The rear cuff rotates freely on shaft 5. The front cuff 2 overlaps the upper end of the shell 4. The overlaping of the shell 4 by the cuff 2 prevents the cuff 2 from pivoting rearwardly during rearward lean. The shell includes a sole 6. The cuffs, shell and sole are relatively rigid and typically constructed of plastic or similar material.

Figure 1:
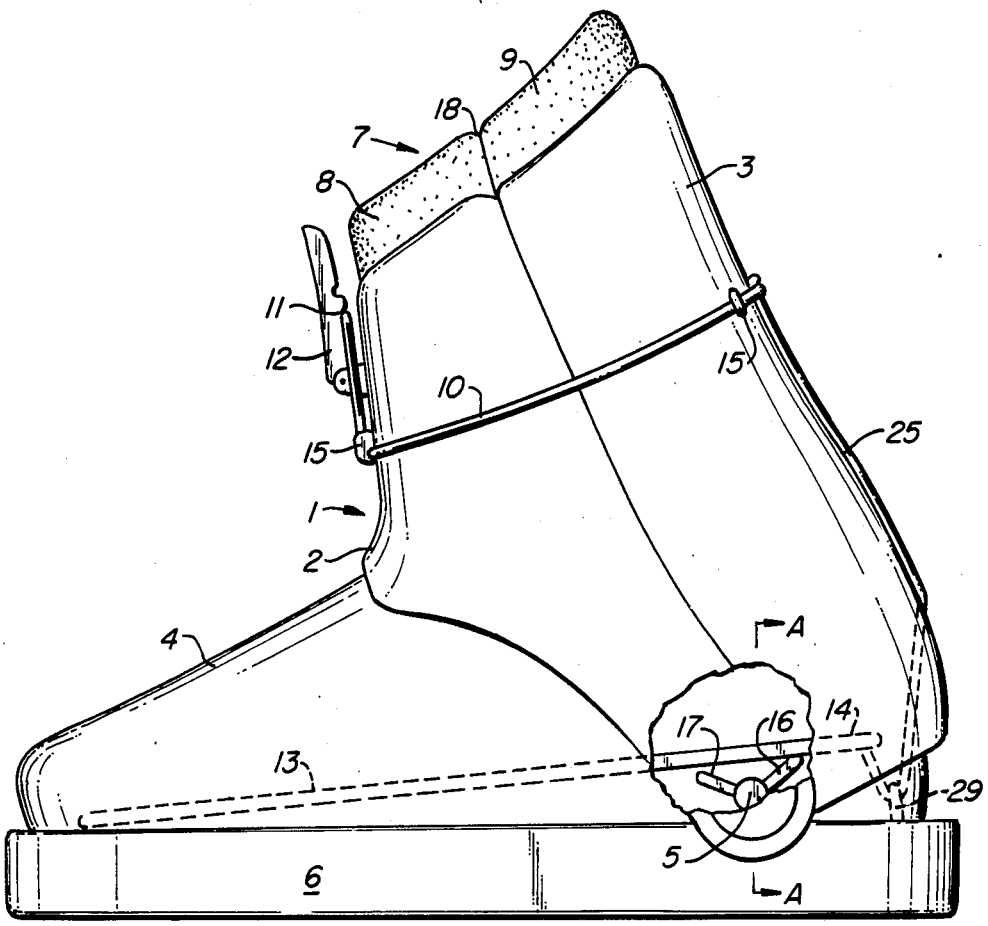
FIG. 1 is a fragmentary side elevational view of the ski boot provided with a multidirectional dynamic fitting system constructed in accordance with the present invention.

In the interior of the cuffs and shell, there is a soft resilient liner 7. The liner 7 provides an initial close, warm comfortable fit. The liner has a forward section 8 and a rearward section 9. To facilitate entry and exit from the ski boot, the two sections are separable along an intermediate line 18 extending from the top of the liner down to approximately the shaft 5. The forward and rearward sections overlap along a line of separation to provide for adjustability of fit.

A cable 10 passes around both sides of the cuffs and is routed through cable guides 15 and through one of a plurality of cable receiving slots 11 of an overcenter buckle 12 located on the front cuff assembly. The buckle assembly is provided to adjust the boot to a close fit and to prevent loosening of the close fit during skiing.

Figure 2:
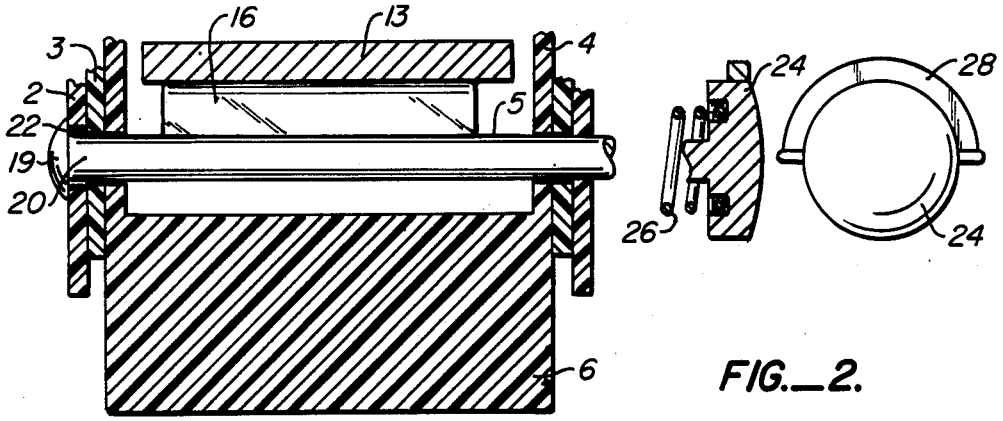
FIG. 2 is a cross sectional view taken along line A—A of FIG. 1.
Figure 3:
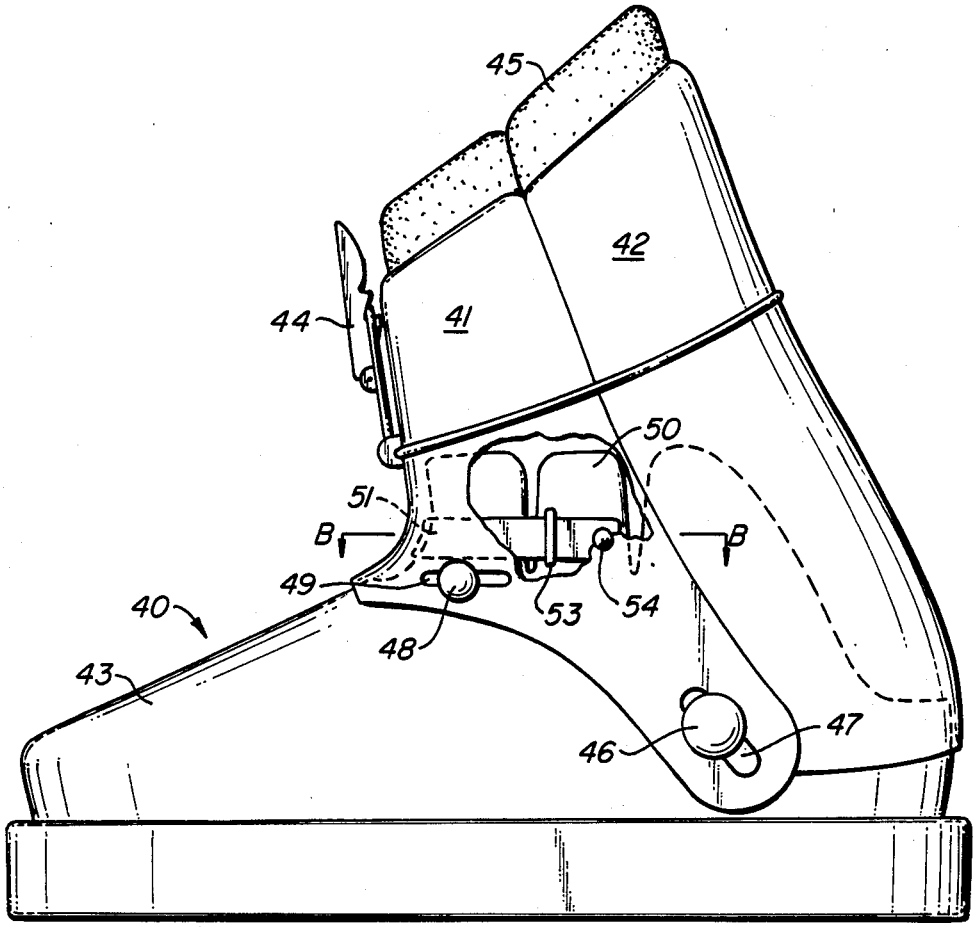
FIG. 3 is a fragmentary side elevational view constructed in accordance with another embodiment of the present invention.
Figure 4:
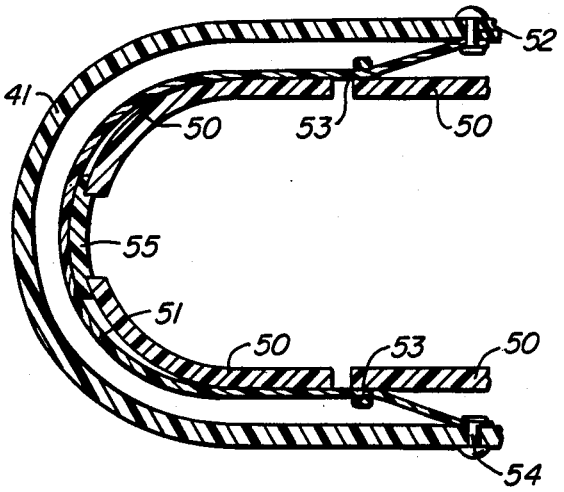
FIG. 4 is a top elevational view taken along line B—B of FIG. 3.

Located in the interior and bottom of the shell 4 and supported on the sole 6 there is a movable footbed 13 which has a rearward end heel receiving portion 14. The forward end of the footbed is suitably supported on the sole 6. The rearward end of the footbed 13 is supported by an elevation plate 16 and an elevation plate 17 which are attached to shaft 5. The shaft includes a head 19 and an adjustment knob 24. On one end of the shaft 5, there is a plurality of teeth 20. Bores in the front cuff 2 receive the shaft and have corresponding teeth 22. The teeth are provided for locking the shaft to the front cuff. The rear cuff includes bores that rotate freely on the shaft. At the opposite end of shaft 5, there is an adjusting knob 24 and spring 26. Rotatably attached to the knob is a movable handle 28. The handle can be rotated outwardly for turning the knob. The shaft 5 may have two sections rotatably connected by a sleeve and two adjustable assemblies such that the elevation plate 16 and elevation plate 17 can be adjusted separately. A cable 25 is connected to the rear of the footbed 13, pases through a guide 29, through a bore in the rear cuff and is connected to cable 10. In use, as the skier leans forwardly in the boot 1, forward rotation of the front cuff 2 rotates the shaft 5 through the mating teeth members on the shaft and cuff. As the shaft 5 is rotated, the elevation plate 16 contacts and raises the movable footbed. As the skier leans rearwardly, the elevation plate 16 is lowered and the elevation plate 17 contacts and raises the movable footbed. As the footbed 13 is elevated, the cable 25 is relatively shortened, inwardly moving and tightening the front and rear cuffs. To provide for an initial adjustment of the normal position of the movable footbed 13 with the cuff 3, the handle 28 is rotated outwardly. With the handle 28 in the proper position for adjusting the knob 24, the knob 24 is pushed inwardly against the force of the spring 26. As the knob 24 is pushed inwardly against the spring 26, the teeth 20 on the end of shaft 5 are disengaged from the teeth 22 in the cuff 2. When the teeth 20 and 22 are disengaged, the shaft 5 can be rotated independently of the cuff 2 to position the movable footbed 13 at a desired normal position. Referring to FIGS. 3 and 4, there is provided a ski boot 40 which has a front cuff 41 and a rear cuff 42 movably attached to a shell 43. In the interior of the cuffs and shell, there is a soft resilient liner 45 essentially the same as the liner provided in the embodiment of FIGS. 1 and 2. A buckle assembly 44 is provided to adjust the boot to a close fit and to prevent loosening of the close fit during skiing. Ski boot 40 includes a primary attachment rivet 46 located on both sides of the shell. The rivet 46 is fixed in position with respect to the shell 43 because it is attached through a bore in shell 43. Front cuff 41 can rotate about rivet 46 and move along a slot 47. A secondary attachment rivet 48 passes through a bore in the side of shell 43 and elongated slot 49 in front cuff 41. Thus, the movement of the front cuff relative to primary attachment rivet 46 can be considered to be both pivotal and linear. The pivotal and linear movement of the front cuff 41 relative to primary attachment rivet 46 is restricted by rivet 48. The pivotal movement accommodates to forward lean and the linear movement allows the cuff to slide forwardly to prevent jamming against the shell and to provide a means for a multidirectial dynamic fitting system. The rear cuff 42 rotates freely on rivet 46. Shell 43 includes a sole and flaps 50.

A strap 51 is attached to the inner side of front cuff 41 by a rivet 52 and is routed around guides 53 on flaps 50 on both sides of shell 43 and is attached by a rivet 54 to the opposite inner side of the front cuff 41. The strap is adjusted by insertion of a shim 55 of various thicknesses between the strap 51 and the flaps 50.

In use, as the skier leans forwardly in the boot 40, the strap 50 is tightened between guides 53 moving the flaps 50 rearwardly and inwardly tightening the flaps on the leg and foot. As the skier leans rearwardly from the normal position in the boot 40, the strap is also tightened between guides 53 moving the flaps 50 rearwardly and inwardly tightening the flaps on the leg and foot.

Figure 5:
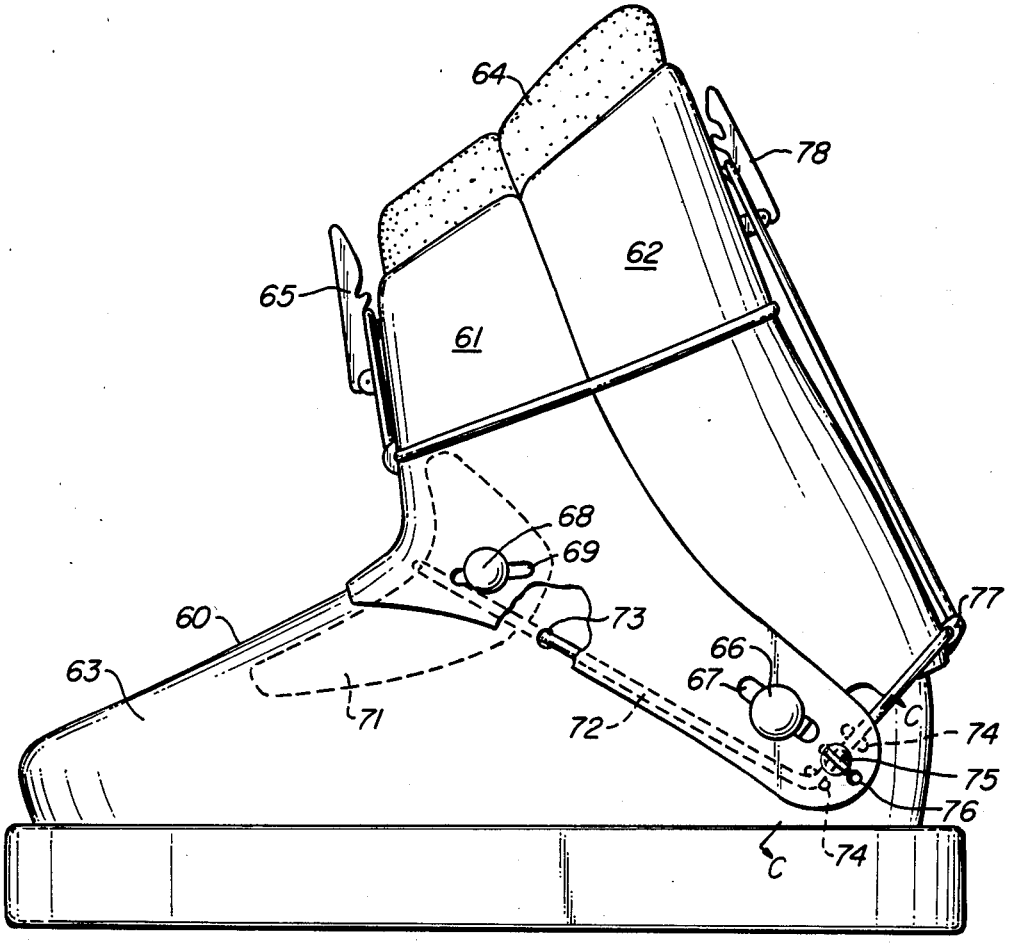
FIG. 5 is a fragmentary side elevational view constructed in accordance with another embodiment of the present invention.
Figure 6:
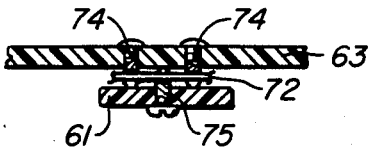
FIG. 6 is a top elevational view taken along line C—C of FIG. 5.

Referring to FIGS. 5 and 6, there is provided a ski boot 60 which has a front cuff 61 and a rear cuff 62 movably attached to a shell 63. In the interior of the cuffs and shell, there is a soft resilient liner 64 essentially the same as the liner provided in the embodiment of FIGS. 1 and 2. A buckle assembly 65 is provided to adjust the boot to a close fit and to prevent loosening of the close fit during skiing. Ski boot 60 includes a primary attachment rivet 66 located on both sides of the shell. The rivet 66 is fixed in position with respect to the shell 63 because it is attached through a bore in shell 63. Front cuff 61 can rotate about rivet 66 and move along a slot 67. A secondary attachment rivet 68 passes through a bore in the side of shell 63 and elongated slot 69 in front cuff 61. Thus, the movement of the front cuff relative to the primary attachment rivet 66 can be considered to be both pivotal and linear as described in the embodiment of FIGS. 3 and 4. The pivotal movement accomodates to forward lean and the linear movement allows the cuff to slide forwardly and rearwardly to provide a means to control the tightening of the fitting system in forward and rearward lean of the skier from the selected normal position.

In the interior of the cuffs and shell there is a tongue 71. The tongue 71 overlies the liner 64 and extends from above the ankle to the forefoot and is provided for engaging the upper surface of the skier's foot in the area of the instep. The tongue 71 is relatively flexible and typically constructed of plastic or similar material. A cable 72 passes over the tongue and is routed through a bore 73 located in each side of the shell 63 and through guide loops 74 located below and behind the primary attachment rivet 66 on each side of the shell. The cable 72 is also routed through sloted guide 75 located on the inside of each side of the front cuff 61 between the guide loops 74. Sloted guide 75 may be press fit or screwed into one of several bores 76 in the front cuff to adjust the cuffs to the selected normal position. The cable 72 then passes upwardly through cable guides 77 to an adjustable overcenter buckle 78 located on the rear cuff.

In use, as the skier leans forwardly in the boot 60, the cable 72 is tightened between guides 74 pulling the tongue 71 rearwardly and downwardly tightening the liner 64 on the leg and foot. As the skier leans rearwardly in the boot 60, the cable 72 is also tightened between guides 74 as guide 75 is moved out of alignment with guides 74, pulling the tongue 71 rearwardly and downwardly against the liner and lower extremity.

I claim:

1. A sport shoe including a shell and cuff comprising means for tightening the fit of the shoe on a leg and foot in response to movement of the leg relative to the foot away from the normal position of the leg relative to the foot, the tightening means including a movable footbed and movable cuff.

2. A sport shoe according to claim 1 wherein the tightening means comprises means for increasing the tightness of the fit on the leg and foot when the leg is moved in a forward or rearward direction from the normal position of the leg relative to the foot.

3. A sport shoe according to claim 1 wherein the tightening means comprises means for moving the footbed upwardly.

4. A sport shoe according to claim 3 wherein the moving means comprises an elevation plate.

5. A sport shoe including a shell and cuff comprising means for tightening the fit of the shoe on a leg and foot in response to movement of the leg relative to the foot away from the normal position of the leg relative to the foot, the tightening means including a movable shell portion.

6. A sport shoe including a shell and cuff comprising means for tightening the fit of the shoe on a leg and foot in response to movement of the leg relative to the foot away from the normal position of the leg relative to the foot, the tightening means including a movable tongue.

7. A sport shoe according to claim 6 wherein the tightening means comprises means for moving the tongue downwardly.

8. A sport shoe according to claim 7 wherein the moving means comprises a tensioning member.

9. A sport shoe including a shell and cuff comprising:

a tongue located interior of the shell and a tensioning member for moving the tongue downwardly for tightening the fit of the shoe on a foot in response to movement of the leg relative to the foot away from the normal position of the leg relative to the foot.

10. A sport shoe including:

a sole and shell combination for receipt of a user's foot;

a cuff, movably secured to the sole and shell combination, sized to encircle a user's lower leg; and means, coupled to the sole and shell combination and the cuff, for increasing the tightness of fit on the user's foot within the sole and shell combination and on the user's lower leg encircled by the cuff when the user's leg is moved relative to the user's foot from a normal position.

11. The sport shoe of claim 10 wherein the tightness increasing means is responsive to movement of the user's leg relative to the user's foot in two different directions.

12. The sport shoe of claim 11 wherein the two different directions are forward and rearward directions.

13. The sport shoe of claim 10 wherein the sole is rigid.

14. The sport shoe of claim 10 wherein the cuff includes a front cuff portion and a rear cuff portion.

15. The sport shoe of claim 10 wherein the cuff completely covers that portion of the user's leg that it encircles.

16. The sport shoe of claim 10 wherein the tightness increasing means including means for constricting the cuff when the user's leg is moved from the normal position in the forward or rearward directions.

17. The sport shoe of claim 10 wherein the tightness increasing means includes a movable footbed supported by an elevator plate, the elevator plate coupled to the cuff for movement according to the position of the cuff relative to the sole and shell combination.

18. The sport shoe of claim 15 wherein the tightness increasing means includes cable means, connected to the movable footbed, for constricting the cuff according to the position of the user's leg relative to the user's foot.

19. The sport shoe of claim 10 wherein the tightness increasing means includes means for constricting a portion of the sole and shell configuration against a user's leg and foot.

20. The sport shoe of claim 10 wherein the tightness increasing means includes a movable tongue.

* * * * *